US005573136A

United States Patent [19]

Page

[11] Patent Number: 5,573,136

[45] Date of Patent: Nov. 12, 1996

[54] PENDULOUS BEVERAGE SERVER

[76] Inventor: Calvin A. Page, P.O. Box 7, So. Wellfleet, Mass. 02633

[21] Appl. No.: 603,295

[22] Filed: Feb. 22, 1996

[51] Int. Cl.[6] ..... A45F 3/00

[52] U.S. Cl. ..... 220/754; 224/148.7; 220/761

[58] Field of Search ..... 220/754, 761, 220/764; 224/201–202, 148, 217, 218

[56] References Cited

U.S. PATENT DOCUMENTS

| | | | |
|---|---|---|---|
| 2,522,391 | 9/1950 | McGonigle | 220/754 |
| 3,199,720 | 8/1965 | Forman et al. | 224/202 |
| 4,117,965 | 10/1978 | Rienzo | 220/754 |
| 4,165,814 | 8/1979 | Seel | 220/754 |
| 4,323,180 | 4/1982 | Sloup | 224/202 |
| 4,339,062 | 7/1982 | Witt, Jr. | 224/148 |
| 4,541,540 | 9/1985 | Gretz et al. | 224/202 |
| 5,165,583 | 11/1992 | Kouwenberg | 220/754 |

*Primary Examiner*—Joseph M. Moy
*Attorney, Agent, or Firm*—Thomas A. Kahrl, Esq.

[57] ABSTRACT

This invention relates to a pendulous beverage server employed for transporting and serving drinks without spilling the contents. More particularly to a beverage server having a tray with recessed cavities in combination with open containers, each container having a base configured to associate with said cavity suspended from a retractable pendulous handle member having a flexible cord with a weight at one end.

9 Claims, 4 Drawing Sheets

PENDULOUS BEVERAGE SERVER

BACKGROUND OF THE INVENTION

1. Field of the Invention (Technical Field)

The present invention relates generally to a pendulous beverage server employed for transporting and serving drinks and associated items without spillage.

2. Background Art

Drink caddies are well known and are commonly employed by people who desire to carry drinks to serve at social occasions. Applicant is aware of prior art including the following U.S. Patents which relate to drink caddy devices which have been developed to be used to serve drinks, as well as canapes. One such device is shown in U.S. Pat. No. 3,964,629, to MCCABE which shows a combined decanter and tray for dispensing and serving beverages in which the tray, the decanter and cup-like receptacles containing beverages to be served may be lifted and transported from place to place by means of the handle of the decanter, but in which the decanter may be removed from the tray by rotating it to a predetermined position relative to the surface of the tray.

Applicant is also aware of U.S. Pat. No. 3,908,877 to KOSISKY which shows a preferably circular tray that contains a plurality of openings which may receive tapered beverage cups and the like and support the same in a stable manner; and also, of U.S. Pat. No. 4,117,965 to RIENZO and shows a self-balancing tray for carrying glasses, cups, canapes which consists of a disc supported by a frame to which a holder is attached. Devices of the type exemplified by U.S. Pat. No. 4,117,965 are directed to a tray suspended in a manner to always be in a horizontal position and consequently cannot be used to prevent slippage by employing centrifugal force.

Despite the teachings of the prior art, there has not been a device for carrying open drink containers and other items susceptible to spilling on a tray which is supported by a flexible cord connected to a tower for swinging the tray without spilling. The present invention permits this by incorporation of a swinging pendulous support including a tower assembly with a bendable cord for imparting a centrifugal force on the items carried on a tray.

Accordingly, it is desirable to provide for a new and improved beverage server which overcomes some of the shortcomings of the prior art and provides for prevention against spillage on land as well as at sea.

SUMMARY OF THE INVENTION

The present invention relates to a pendulous beverage server employed for transporting and serving drinks and other associated items without spilling.

In particular the present invention is directed to a device for carrying drinks to serve at social occasions together with associated items. Typically such items include canapes served with drinks and also fragile items such as china cups for coffee and tea carried from a kitchen to a den. The present invention is also directed to a device particularly well adapted to carrying drinks and associated items while on board a vessel at sea, typically from a ship's galley to the captain's quarters. By providing this new and improved device with improved control of spillage, it is possible for individuals to serve drinks and other items on land or at sea, even with rough sea conditions, without fear of spillage. With the device of the present invention, the items carried can be readily accessed by a plurality of users by placing the beverage server on a table and releasing the handle whereupon the cord is retracted by the weight such that the cap resides on the top of the tower and the cord is concealed within the tower. In this mode, the tower assembly has the appearance of a lighthouse as the handle is in the form of a cap configured to resemble the beacon portion of a light house.

The employment of pendulous support mounted on a tower of the present invention permits this by incorporation of a flexible cord member supported on a tower member at a point above the drinks and other item carried. The present invention also includes a means for retracting the flexible cord, wherein said flexible cord includes said handle at one end and a weight at the other end, said weight configured to move the handle between an extended transport position and a retracted position. When in the retracted position said flexible cord is contained within a hollow chamber provided in the tower. Typically said flexible cord is employed for movably supporting the tray when in the extended position with a swinging, pendulous motion whereby a centrifugal force is imparted to liquid contents of said open containers and items.

Furthermore, the present invention features a beverage server having a tray member with recessed cavities for preventing slippage on the tray by open container vessels, each vessel preferably having a base configured to associate with said cavity.

In the preferred embodiment, the pendulous support includes pendulum means for supporting the tray member and comprising flexible cord having a handle formed as a lighthouse beacon at one end and a weight at the other end, said weight configured to move the handle between an extended transport position and a retracted position. When the handle is released by the server, the flexible cord is drawn into a hollow interior chamber in the tower and is therein contained and the handle in the form of the lighthouse beacon resides on the top of the tower to provide the appearance of a lighthouse.

The primary object of the present invention is to provide a device which can be used to serve drinks in open containers and without spilling the contents.

Another object of the present invention is to provide a device which incorporates a retractable handle to provide ease of access to the items carried on the tray, particularly when deposited on a support such as a table.

A further object of the present invention is to provide a device which has a retractable handle in the form of a light house beacon on a flexible cord such that the cord may be concealed when the handle is retracted such that the tower assumes the shape of a lighthouse.

Accordingly, it is desirable to provide for a new and improved Drink Caddy to provide for a pendulous beverage server employed for transporting and serving drinks without spilling the contents which overcomes at least some of the disadvantages of prior art.

Other objects, advantages, and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The invention will be described for the purposes of illustration only in connection with certain embodiments; however, it is recognized that those persons skilled in the art may make various changes, modifications, improvements and additions on the illustrated embodiments all without departing from the spirit and scope of the invention.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

DETAILED DESCRIPTION OF THE PREFERRED EMBODIMENT

Figure 1:
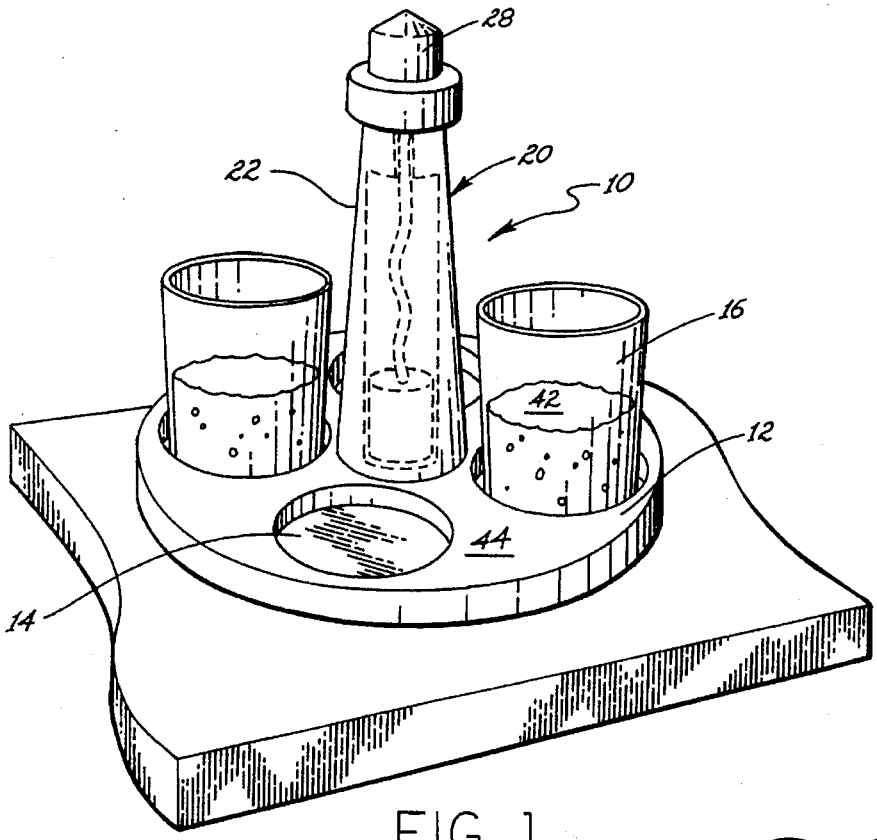
FIG. 1 is a perspective view of the present invention including open containers positioned on a support, typically a table.

Referring to FIGS. 1–4 there is shown a beverage server device 10 consisting of a tray 12 having a central axis including a plurality of cavities 14 equidistantly spaced, each cavity 14 characterized by a circular recess for receiving open containers 16 and other items 18 upon said tray. As is shown in FIG. 1, a tower assembly 20 is mounted on said circular tray extending upwardly along said central axis comprising a frustum 22 consisting of a truncated cone characterized by a central hollow chamber 24.

Figure 4:
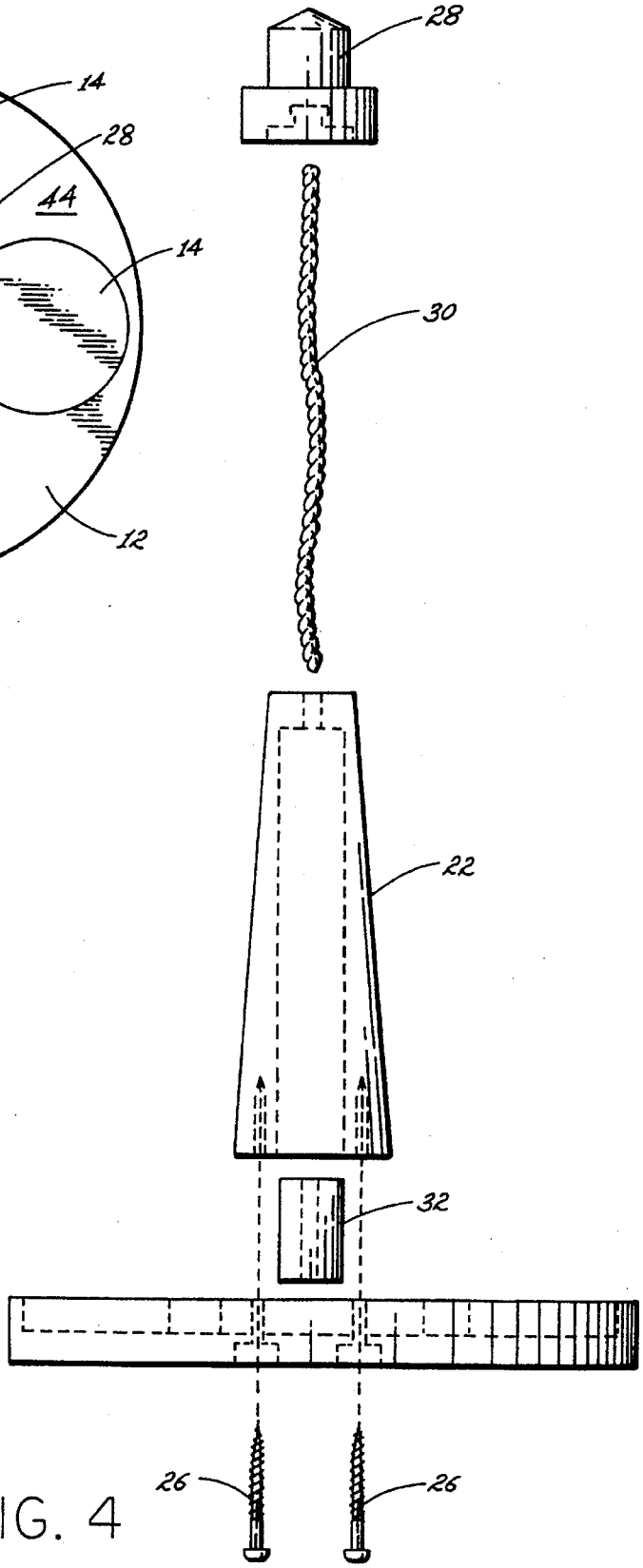
FIG. 4 is an exploded side view of the invention of FIG. 1 showing the individual components.

As is shown in FIG. 4, showing an exploded side view of the individual components, there is shown mounting screws 26 for attaching the tower assembly 20 to the tray 12; a handle 28 in the form of a lighthouse beacon connected to a flexible cord 30 having said handle at one end and a weight 32 at the other end. In the preferred embodiment weight 3 is configured to move handle 28 between an extended transport position and a retracted position. As is shown in FIG. 1 said flexible cord is contained with in said hollow chamber and this is not visible.

Figure 2:
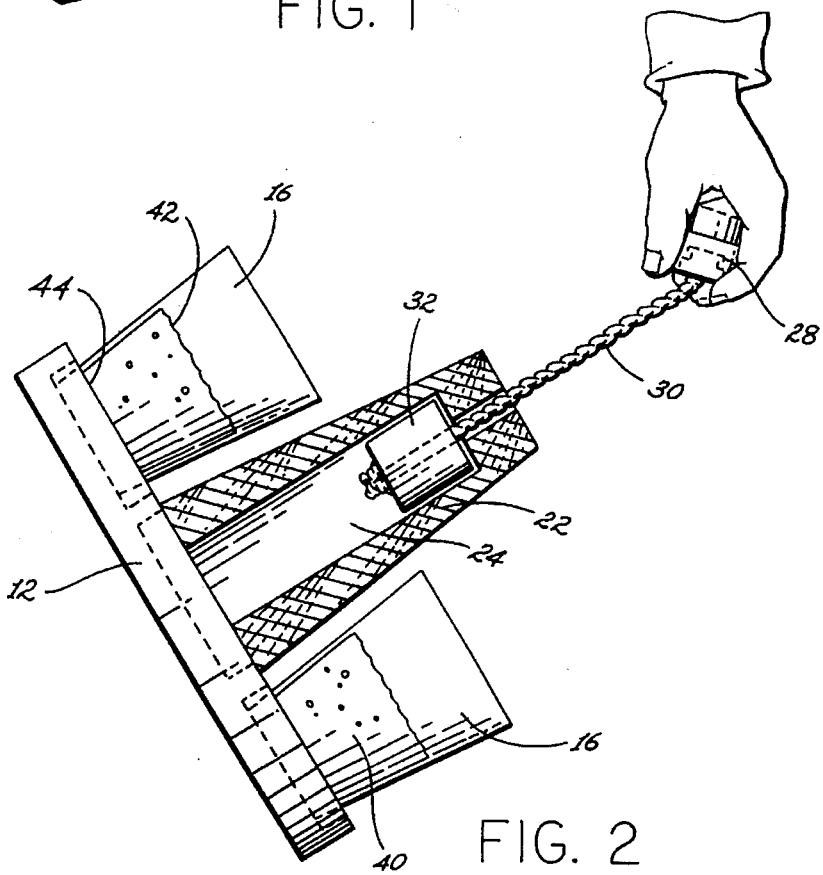
FIG. 2 is a perspective view of the invention of FIG. 1 being carried with a swinging action with the surface of the liquid parallel with surface of the tray.
Figure 3:
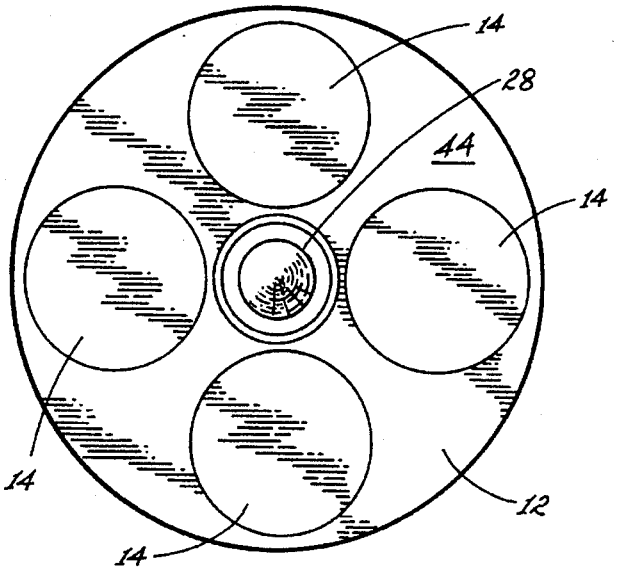
FIG. 3 is a top view of the invention if FIG. 1 shown without open containers.

As is shown in FIG. 2, flexible cord 30 is employed for movably supporting tray 12, when in the extended position, with a swinging, pendulous motion whereby a centrifugal force is imparted to liquid contents 40 of said open containers such that the liquid surface 42 remains substantially parallel with the surface 44 of tray 12, and spillage of the contents is thereby prevented.

ASSEMBLY AND DISASSEMBLY OF THE PENDULOUS BEVERAGE SERVER

Referring to FIG. 4, there is shown the components of the beverage server 10, fully disassembled in an exploded view. Assembly is effected by assembling the components of the tower assembly 20 including a frustum 22 consisting of a truncated cone characterized by a central hollow chamber 24, mounting means 26 for attaching the tower assembly 20 to the tray 12, a handle 28 in the form of a lighthouse beacon, a flexible cord 30 having said handle at one end and a weight at the other end, said weight configured to move the handle 28 between an extended transport position and a retracted position whereby said flexible cord is contained within said hollow chamber. Mounting is accomplished by inserting the screws 26 through the tray 12 from the bottom. Next the screw holes must be aligned in the tower assembly 20 with the protruding screws 26 and alternatively tighten the screws 26 until both screws are snug.

Figure 5:
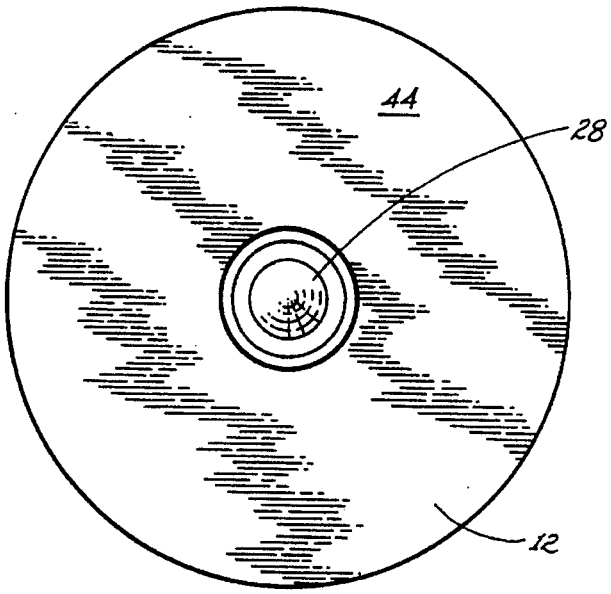
FIG. 5 is a top view of and alternate embodiment of the invention if FIG. 1 shown without cavities in the tray.

Referring to FIG. 5, there is shown a beverage server device 10 of an alternate embodiment consisting of a tray 12 having a smooth top surface 50 for supporting open containers.

Figure 6:
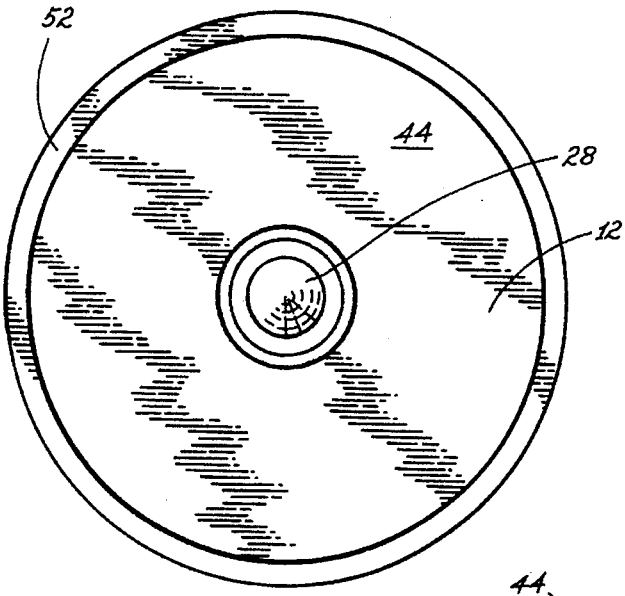
FIG. 6 is a top view of a further alternate embodiment of the invention if FIG. 5 shown with a rim on the outer edge of the tray.

Referring to FIG. 6 there is shown a beverage server device 10 of yet another embodiment consisting of a tray 12 having a smooth top surface 50 and an outer rim 52 for supporting open containers 16.

Figure 7:
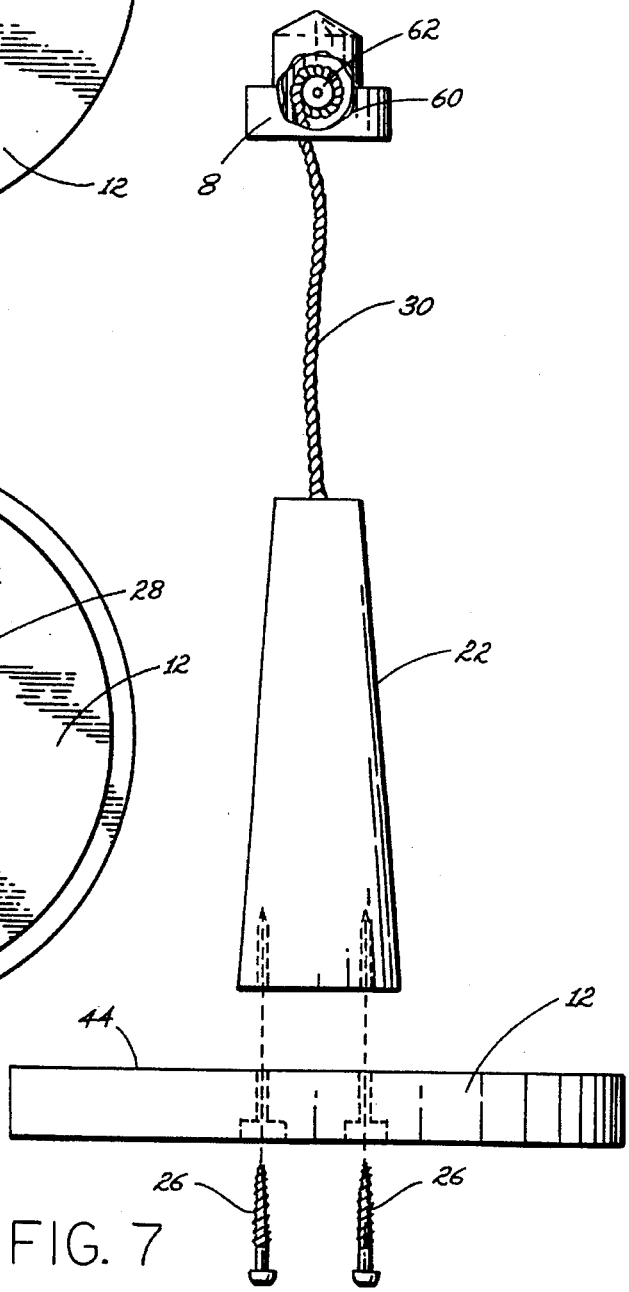
FIG. 7 is an exploded side view of and alternate embodiment of the invention of FIG. 1 shown with a retractable handle with a reel device, without a weight attached to the flexible cord.
Figure 8:
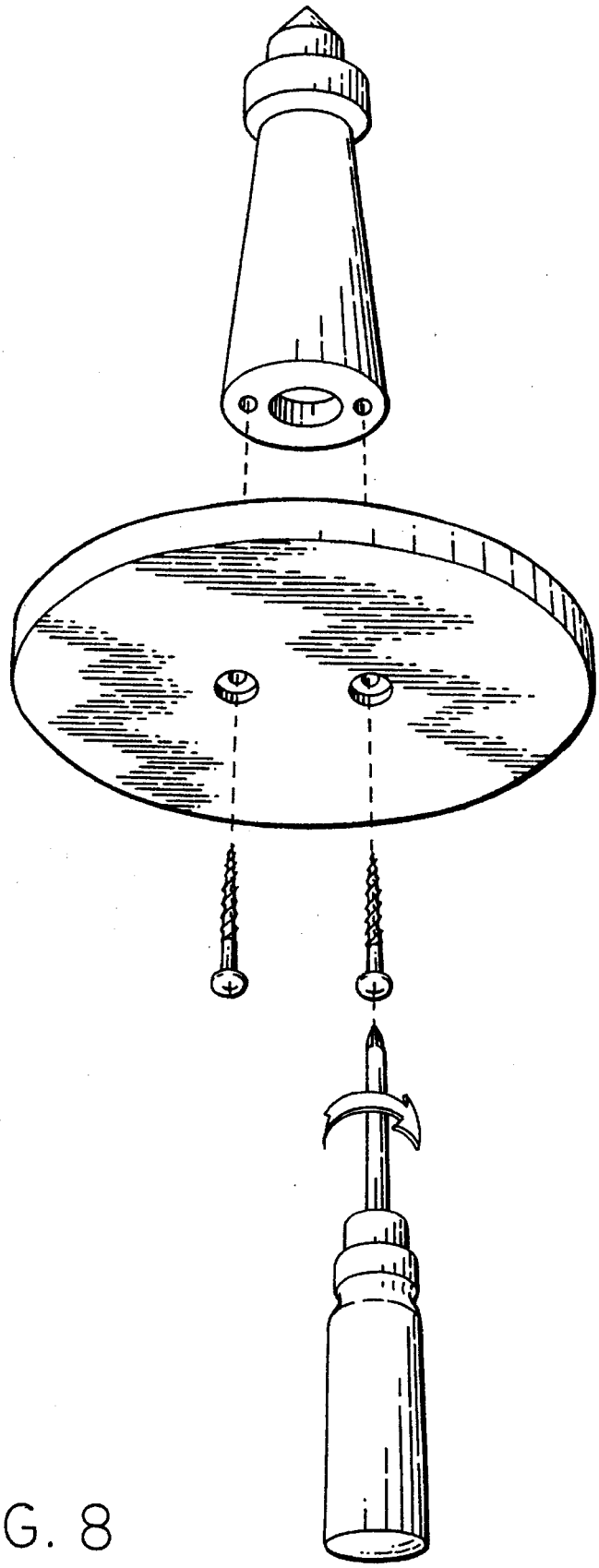
FIG. 8 is an exploded view of another alternate embodiment.

Referring to FIG. 7 there is shown a further embodiment consisting of a beverage server device 10 consisting of a tray 12 for receiving open containers 16 and other items 18 upon said tray. As is shown in FIG. 7, a tower assembly 20 is mounted on said circular tray extending upwardly along said central axis comprising a frustum 22 consisting of a truncated cone. As is shown in FIG. 7 an exploded side view of and alternate embodiment of the invention if FIG. 1 shown with a retractable handle 60 with a reel device 62 without a weight attached to the flexible cord 30.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. A pendulous beverage server employed for spill-free transporting open containers having liquid contents, fragile items and spillable items comprising;

a) a tray for receiving open containers;

b) a tower assembly mounted on said tray extending upwardly along said central axis comprising;

i) a frustum consisting of a truncated cone characterized by a central hollow chamber; and ii) mounting means for attaching the tower assembly to the tray c) pendulum means for movably supporting the tray comprising flexible cord having a handle at one end and a weight at the other end, said weight configured to move said pendulum means between an extended transport position and a retracted position; wherein said flexible cord is employed for movably supporting the tray when in the extended position with a swinging, pendulous motion whereby a centrifugal force is imparted to liquid contents of said open containers and items.

2. The device of claim 1, wherein said pendulous beverage server is employed on shipboard to counteract the rock and roll action due to sea conditions for manually transporting beverages with said flexible cord is employed to impart a centrifugal force to liquid contained in beverage container such that the surface remains parallel with each base such that spillage is prevented.

3. The device of claim 1, wherein said tray includes a circular base having a central axis including container-receiving openings equidistantly spaced, each characterized by a recess for surrounding a base of a beverage container such to hold the base of the glasses to aid in the prevention of spillage.

4. The device of claim 3, wherein said flexible cord is completely contained in said hollow chamber when said pendulum means is in the retracted position and thereby is concealed from view.

5. The device of claim 1, wherein said truncated cone is in the shape of a lighthouse and said handle is in the shape of a light house beacon.

6. The device of claim 4, wherein said flexible cord is employed to generate a centrifugal force which is imparted to containers and items such that they remain positioned in the cavities and do not slide off the tray.

7. The device of claim 2, wherein said wherein a centrifugal force is imparted to liquid contained in open beverage containers comprising a plurality of at least two vessels, each vessel having a base associated with a recess in said tray; wherein as the pendulous beverage server is manually transported by a person serving the beverages, the pendulum means is employed to impart a centrifugal force to liquid contained in beverage contain such that the surface of the liquid remains parallel with the tray.

8. The device of claim 1, wherein the height of the tower assembly is selected to extend upwardly a distance greater than the height of the open containers.

9. A spill-free beverage server employed for transporting open containers having liquid contents, fragile items and spillable items comprising;

a) a circular tray for receiving open containers and other items;

b) a tower assembly mounted on said tray comprising;
   i) a frustum consisting of a truncated cone; and
   ii) mounting means for attaching the tower assembly to the tray;

c) pendulum means for movably supporting the tray comprising a handle attached to a flexible cord in association with retractable means configured to move the handle between an extended transport position and a retracted position; wherein said flexible cord is employed for movably supporting the tray when in the extended position with a swinging, pendulous motion whereby a centrifugal force is imparted to liquid contents of said open containers and items.

* * * * *